US005685602A

United States Patent [19]

Williams

[11] Patent Number: 5,685,602

[45] Date of Patent: Nov. 11, 1997

[54] COLLAPSIBLE DESK AND CHAIR APPARATUS

[76] Inventor: Willis Ray Williams, 3129 Pinewood Dr., Arlington, Tex. 76010-0114

[21] Appl. No.: 670,027

[22] Filed: Jun. 25, 1996

[51] Int. Cl.[6] ..... A47B 39/00

[52] U.S. Cl. ..... 297/174; 297/173

[58] Field of Search ..... 297/174, 173, 297/170, 171, 135, 156, 163, 167; 108/120

[56] References Cited

U.S. PATENT DOCUMENTS

| | | | |
|---|---|---|---|
| 633,762 | 9/1899 | Kade | 108/120 |
| 2,656,232 | 10/1953 | Raphael | 108/102 |
| 2,817,170 | 12/1957 | Skelton et al. | 297/174 |
| 3,141,424 | 7/1964 | Seymour | 108/120 X |
| 3,420,571 | 1/1969 | Moore | 297/135 |

FOREIGN PATENT DOCUMENTS

| | | | |
|---|---|---|---|
| 166286 | 7/1950 | Austria | 297/171 |

*Primary Examiner*—Milton Nelson, Jr.
*Attorney, Agent, or Firm*—Henderson & Sturm

[57] ABSTRACT

A collapsible desk and chair apparatus 10 including a one piece desk member 20 having two pairs of support legs 30, 30 and 31, 31 pivotally connected thereto and to one another and a seat unit 13 pivotally connected to both the desk member 20 and one of the pairs 30, 30 of support legs. The other pair of support legs 31, 31 are both pivotally and moveably connected to the underside 22 of the desk member 20.

17 Claims, 2 Drawing Sheets

COLLAPSIBLE DESK AND CHAIR APPARATUS

TECHNICAL FIELD

The present invention relates to the field of collapsible furniture in general, and in particular to an adjustable desk and chair apparatus.

BACKGROUND ART

As can be seen by reference to the following U.S. Pat. Nos. 1,514,418; 2,197,302; 3,427,069; and 4,289,350, the prior art is replete with myriad and diverse collapsible furniture devices.

While all of the aforementioned prior art constructions are more than adequate for the basic purpose and function for which they have been specifically designed, they are uniformly deficient with respect to their failure to provide a simple, efficient, and compact arrangement for a collapsible desk and chair apparatus, wherein the apparatus occupies the minimum possible storage space while not in use and which is very easy to deploy in its operative mode, while also providing a very stable platform surface for both the table and chair members.

As users of the existing prior art constructions are all to painfully aware, the currently available collapsible desk and chair arrangements are difficult to assemble, require too much storage space when not in use, and are difficult to transport from one location to another.

Educators in a limited space multi-use classroom environment and parents with pre-schoolers have long realized the benefit of having a well constructed collapsible desk and chair apparatus that could be employed by young children for work, play, eating, studying, etc.

In addition, target shooters are always looking for collapsible shooting benches having a stable support for their firearms and accessories while also providing a comfortable seating arrangement.

As a consequence of the foregoing situation, there has existed a longstanding need for a new and improved collapsible desk and chair apparatus that is simple to use, compact during storage, adapted for a variety of functional purposes, and provides extremely stable work and torso supporting surfaces for the user, and the provision of such a construction is a stated objective of the present invention.

DISCLOSURE OF THE INVENTION

Briefly stated, the collapsible desk and chair apparatus that forms the basis of the present invention includes a table unit, a table support unit pivotally connected to the table unit, and a seat unit pivotally connected to the table support unit.

As will be explained in greater detail further on in the specification, the table support unit includes two pairs of support legs that are pivotally connected to one another and comprise the primary support structure for the apparatus. One of the pairs of support legs is elongated so that they will extend a greater distance beyond the table unit such that the seat unit which is pivotally associated with the elongated pair of support legs can be spaced from the overhang of the table unit.

Furthermore, the other pair of support legs is both slidably and pivotally associated with the track elements disposed beneath the table unit such that both pairs of support legs may be disposed into a spring biased opening movement relative to the table unit.

In addition, the apparatus is specifically designed and contoured to accommodate adjacent portions of the apparatus to produce the smallest possible apparatus profile during storage and/or transport. Furthermore, the various support arms and legs of the apparatus are spaced from one another such that they not only do not interfere with one another, but, in some instances captively surround each other to further diminish the apparatus profile.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
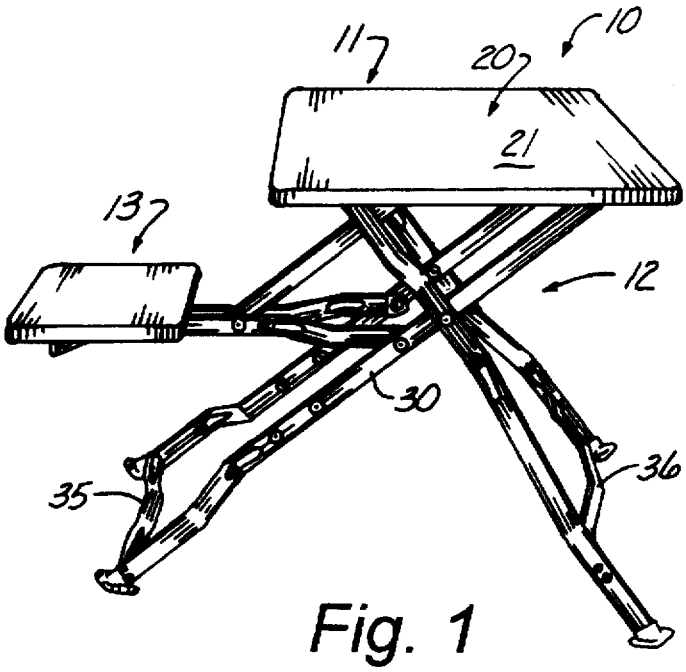
FIG. 1 is a perspective view of the desk and chair apparatus that forms the basis of the present invention.

As can be seen by reference to the drawings, and in particularly to FIG. 1, the collapsible desk and chair apparatus that forms the basis of the present invention is designated generally by the reference number 10. The apparatus 10 comprises in general, a desk unit 11, a desk support unit 12, and a seat unit 13. These units will now be described in seriatim fashion.

As shown in FIGS. 1 through 4, the desk unit 11 comprises an enlarged generally rectangular one-piece desk member 20 having a top surface 21, and a bottom surface 22 provided with a pair of elongated channel track elements 23 disposed in a parallel and spaced apart relationship relative to one another. The purpose and function of the channel track elements 23 will be explained presently.

Figure 3:
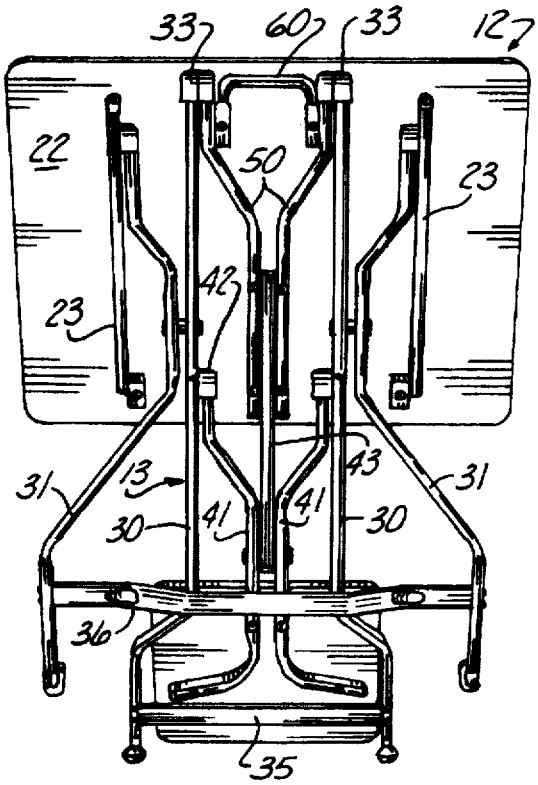
FIG. 3 is a rear plan view of the apparatus in the collapsed mode.
Figure 4:
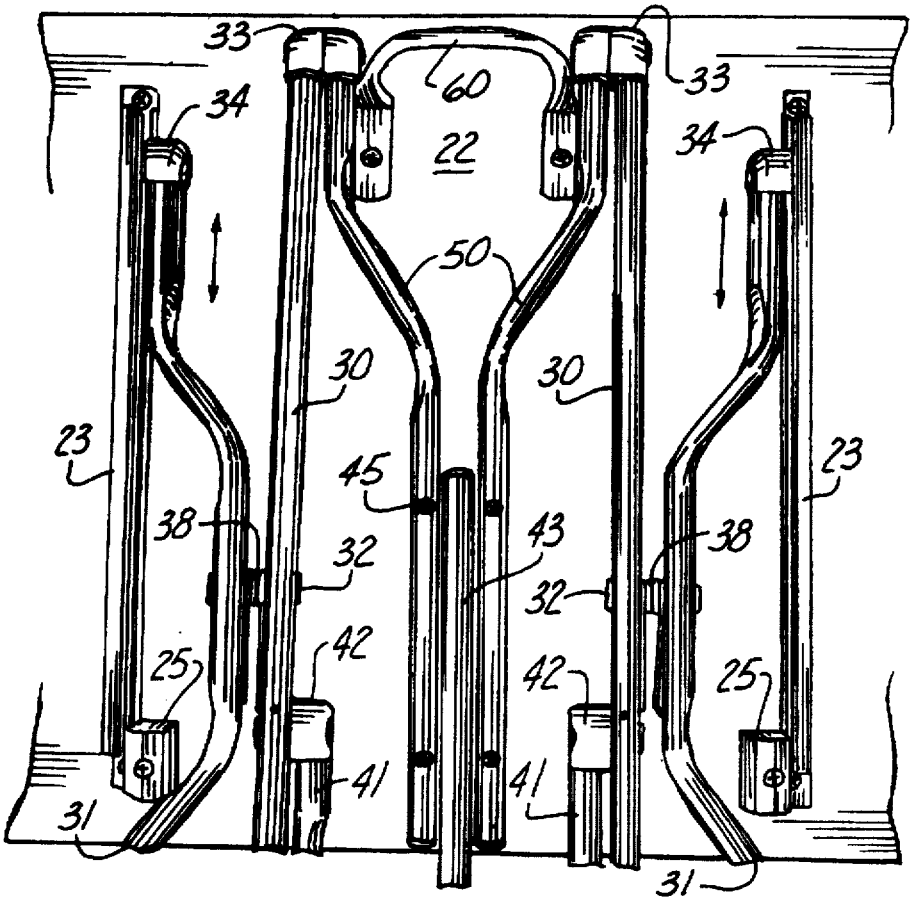
FIG. 4 is a enlarged detail view of the upper portions of the table support unit.

As can best be seen by reference to FIGS. 3 and 4, the desk support unit 12 comprises two pairs 30, 30 and 31, 31 of support legs that are operatively associated with the bottom surface 22 of the desk member 20 and pivotally secured to one another as at 32, 32 proximate their respective midpoints.

The first pair of support legs 30, 30 are pivotally and fixedly secured on their upper ends 33 to the bottom surface 22 of the desk member 20. The second pair of support legs 31, 31 are pivotally and moveably connected on their upper ends 34, 34 within the channel track elements 23 for reasons that will be explained in greater detail further on in the specification.

As can be appreciated particularly by reference to FIG. 3, the first pair of support legs 30, 30 are substantially straighter and longer than the second pair of support legs 31, 31. The upper and intermediate portions of the support legs 30, 30 are relatively closely spaced and parallel to one another. The lower portion of the support legs 30, 30 are slightly outwardly flared and connected to one another by a relatively short cross-piece member 35.

Still referring to FIG. 3, it can be seen that the second pair of support legs 31, 31 have a contoured configuration including a slightly inwardly flared intermediate portion and a substantially outwardly flared lower portion wherein the lower portions of the support legs 31, 31 are connected to one another by an elongated contoured cross-piece member 36 having an outwardly bowed intermediate portion dimensioned to accommodate the lower portion of the first pair of support legs 30, 30 when the apparatus 10 is disposed in the collapsed mode.

Returning once more to FIGS. 3 and 4, it can be seen that the seat unit 13 comprises in general a seat member 40 provided with a pair of contoured seat support arms 41, 41 which are fixedly secured on their outboard ends to the seat member 40 and are pivotally secured on their inner ends as at 42, 42 to the intermediate portion of the first pair of support legs 30, 30.

In addition, the seat unit 13 further includes an angled brace element 43 which is pivotally secured on its lower end to the intermediate portions of the contoured seat support arms 41, 41 and which is pivotally secured on its upper end as at 45 to the bottom surface 22 of the desk member 20.

At this juncture, it should be noted that in the preferred embodiment of the invention depicted in FIG. 4, both the pivoted connection of the upper end of the angled brace element 43 and the upper ends of the first pair of support legs 30, 30 are accomplished via an intermediary pair of contoured support arms 50, 50 which are rigidly secured to the bottom surface 22 of the desk member 20. Whereas, the intermediary pair of contoured support arms 50, 50 are provided primarily for the purpose of providing rigidity and support to the desk member 20. It is to be understood that individual conventional pivot support structures (not shown) could be substituted therefor, and still fall within the teachings of this invention.

Figure 2:
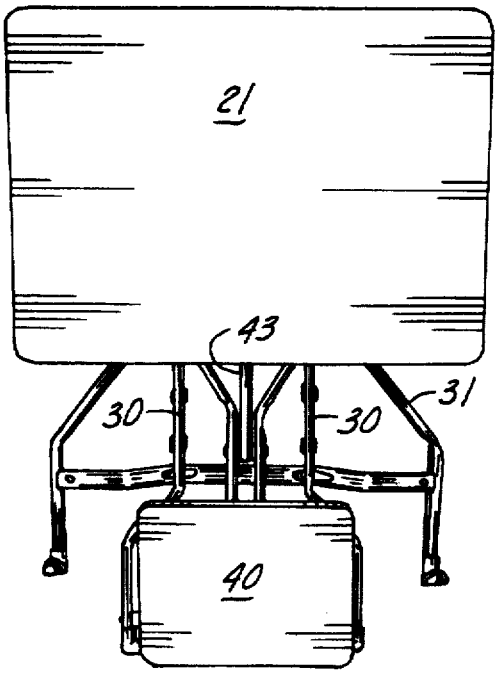
FIG. 2 is a front plan view of the apparatus in the collapsed mode.
Figure 7:
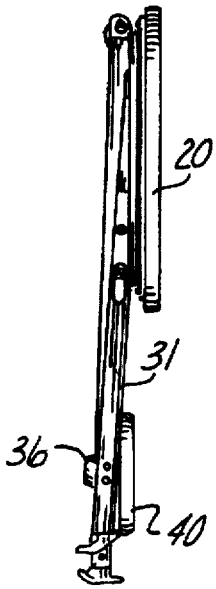
FIG. 7 is a side elevation view of the apparatus in the collapsed mode.
Figure 5:
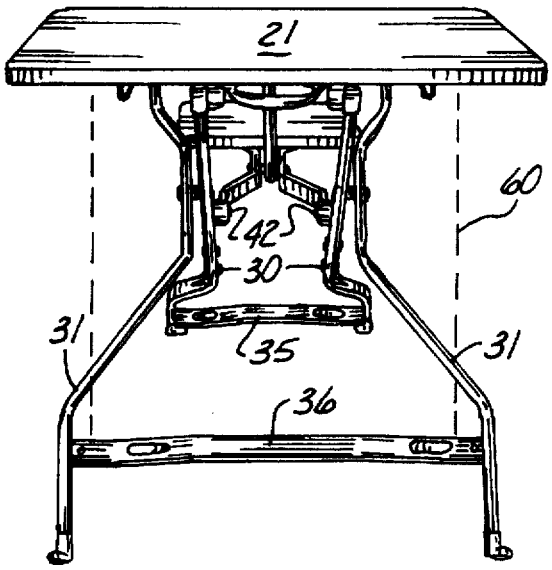
FIG. 5 is a rear elevation view of the apparatus in the operational mode.
Figure 6:
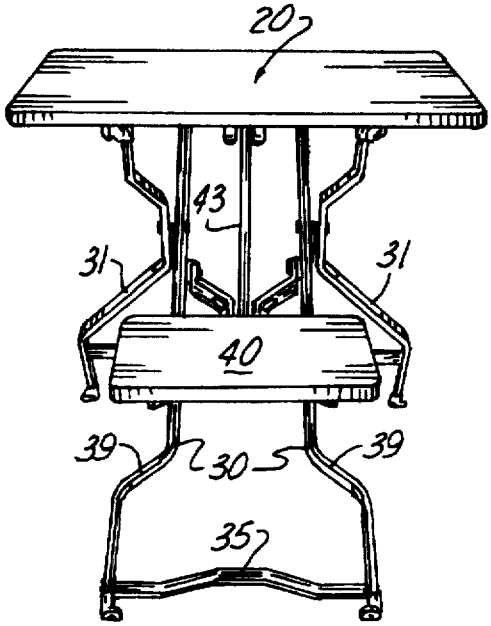
FIG. 6 is a front elevation view of the apparatus in the operational mode.

It should further be noted by reference to FIG. 4, that the first 30, 30 and second 31, 31 pairs of support legs are normally biased into their open disposition by a pair of spring elements 38 which are in operative contact with adjacent pairs of support legs at their pivoted connection 32 to facilitate the transition of the apparatus 10 from the collapsed mode of FIGS. 2 and 7 to the operative mode of FIGS. 5 and 6.

In addition, a handle member 60 is rigidly affixed to the bottom surface 22 of the desk member 20 to facilitate the transport of the apparatus 10 from one location to another. A pair of stop elements 25, 25 are positioned adjacent the open end of the channel track elements 23, 23 to prevent the second pair of support legs 31, 31 from becoming disengaged with the channel track elements 23, 23.

As can best be seen by reference to FIGS. 1 through 3, the first pair of table support legs 30, 30 are substantially longer than the second pair of support legs 31, 31 for the simple reason that the seat unit 13 must be cantilevered out from the desk member 20 in its operative mode of disposition. Furthermore, while the upper ends of the first pair of table support legs 30, 30 are connected to the underside 22 of the desk member 20 in a straightforward pivoted fashion, the upper ends of the second pair of support legs 31, 31 are both pivotally and moveably disposed in the channel track elements 23 so that the second pair of support legs 31, 31 can be translated from the storage position of FIGS. 3 and 4 to the operative position of FIGS. 5 and 6.

When the apparatus 10 is in the fully collapsed mode depicted in FIG. 7, the width of the apparatus 10 equals the combined width of the outer pair of support legs 31 plus the thickness of the desk member 20. This exceptionally slim profile is made possible both by the nesting contour of the structural components illustrated in FIGS. 3 and 4, as well as the unique moveable pivot arrangement produced by the channel track elements 23.

Since the primary purpose and function of the apparatus 10 is in a classroom environment, this invention also contemplates the provision of a removable and/or retractable privacy screen 60 as depicted in phantom in FIG. 5.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A collapsible desk and chair apparatus including:

a one piece desk member having a top surface and bottom surface;

a first pair of support legs pivotally secured to the bottom surface of the desk member at a fixed location;

a second pair of support legs pivotally secured to the bottom surface of the desk member at a moveable location; wherein, the intermediate portions of the first and second pairs of support legs are pivotally secured to one another; and a seat unit pivotally associated with one of said pairs of support legs and the bottom surface of the desk member; wherein the seat unit comprises:

a seat member; and a pair of seat support arms fixedly secured on one end to said seat member and pivotally secured on the other end to one of said pairs of support legs.

2. The apparatus as in claim 1 wherein the bottom surface of the desk member is provided with a pair of channel track elements; and the upper ends of the second pair of support legs are slidably and pivotally received in said channel track elements.

3. The apparatus as in claim 2 further comprising:

spring means operatively associated with said first and second pairs of support legs for biasing said pairs of support legs into a spring biased open position.

4. The apparatus as in claim 1 wherein the seat unit further includes:

means for maintaining the seat member in a horizontal disposition.

5. The apparatus as in claim 1 wherein the seat unit further includes:

an angled brace element which is pivotally connected on one end to the bottom surface of the desk member and pivotally secured on the other end to the pair of seat support arms.

6. The apparatus as in claim 1 wherein the first pair of support legs are dimensioned to nest within the second pair of support legs.

7. The apparatus as in claim 6 wherein the seat support arms are dimensioned to nest within the first pair of support legs.

8. The apparatus as in claim 1 further including:

biasing means for biasing said first and second pairs of support legs into an open position relative to one another.

9. The apparatus as in claim 1 wherein the first pair of support legs are substantially longer than the second pair of support legs.

10. The apparatus as in claim 9 wherein the second pair of support legs are substantially wider than the first pair of support legs.

11. The apparatus as in claim 10 wherein the first pair of support legs have a slightly outwardly flared lower portion.

12. The apparatus as in claim 11 wherein the second pair of support legs have a slightly inwardly flared upper portion and a substantially outwardly flared lower portion.

13. A collapsible desk and chair apparatus including:

a one piece desk member having a top surface and bottom surface;

a first pair of support legs pivotally/secured to the bottom surface of the desk member at a fixed location;

a second pair of support legs pivotally secured to the bottom surface of the desk member at a moveable location; wherein, the intermediate portions of the first and second pairs of support legs are pivotally secured to one another; and a seat unit pivotally associated with one of said pairs of support legs and the bottom surface of the desk member; wherein the seat unit comprises:

a seat member; and a pair of seat support arms secured on one end to said seat member and secured on the other end to one of said pairs of support legs.

14. The apparatus as in claim 13 wherein the seat unit further includes:

means for maintaining the seat member in a horizontal disposition.

15. The apparatus as in claim 14 wherein the seat unit further includes:

an angled brace element which is pivotally connected on one end to the bottom surface of the desk member and pivotally secured on the other end to the pair of seat support arms.

16. The apparatus as in claim 13 wherein the first pair of support legs are dimensioned to nest within the second pair of support legs.

17. The apparatus as in claim 16 wherein the seat support arms are dimensioned to nest within the first pair of support legs.

* * * * *